US005079795A

United States Patent [19]

Schmid

[11] Patent Number: 5,079,795

[45] Date of Patent: Jan. 14, 1992

[54] LADDER ACCESSORY

[76] Inventor: Roy Schmid, 170 Autumn Dr., Southington, Conn. 06489

[21] Appl. No.: 478,550

[22] Filed: Feb. 12, 1990

[51] Int. Cl.[5] ..... B44D 3/12; E06C 7/14

[52] U.S. Cl. ..... 15/257.06; 211/126; 220/347; 248/211; 248/238

[58] Field of Search ..... 15/257.05, 257.06; 248/210, 211, 238; 211/126; 220/345-347

[56] References Cited

U.S. PATENT DOCUMENTS

| | | | |
|---|---|---|---|
| 2,883,134 | 4/1959 | O'Halloran | 248/210 |
| 3,707,242 | 12/1972 | Golden et al. | 15/257.06 |
| 4,424,949 | 1/1984 | Kimmett et al. | 15/257.06 X |
| 4,515,242 | 5/1985 | LaChance | 248/238 X |
| 4,946,057 | 8/1990 | Connolly et al. | 220/347 X |

FOREIGN PATENT DOCUMENTS

| | | | |
|---|---|---|---|
| 691189 | 5/1953 | United Kingdom | 248/211 |

*Primary Examiner*—Edward L. Roberts
*Attorney, Agent, or Firm*—Victor E. Libert

[57] ABSTRACT

A ladder accessory (10) is conveniently mounted on a ladder (L) having spaced side rails (S) and a plurality of spaced rungs (R, R') connected thereto. The ladder accessory (10) includes a mounting means 46 and a support fixture which may be a tray (12) having side walls (22, 24) and an end wall (20) which all terminate in a marginal rim (26). A cover (14) covers at least a portion of the tray (12) and is slidably engagable on the rim (26). A support member (46) extends transversely from one of the side walls (22) to form an arrangement to mount the ladder accessory (10) on a ladder side rail (S). Hooks (54, 55) engage rungs (R, R') of the ladder (L) to hold the tray assembly (10) substantially parallel to the side rail (S). The support fixture may be some other suitable fixture such as a shelf member (64).

12 Claims, 6 Drawing Sheets

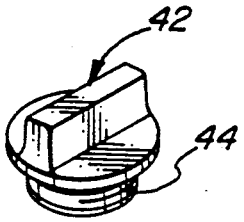
FIG. 1C
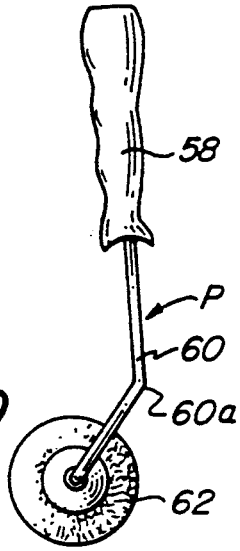
FIG. 1D
FIG. 1A
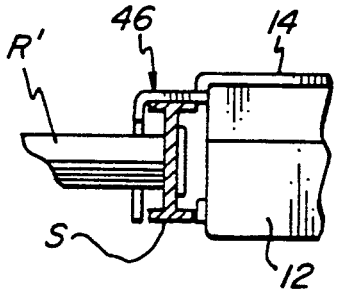
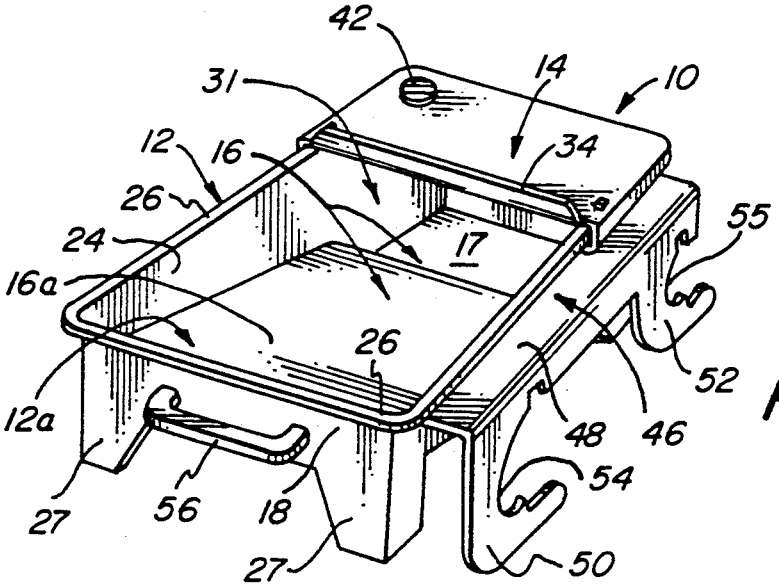
FIG. 3

LADDER ACCESSORY

BACKGROUND OF THE INVENTION

1. Field of the Invention

The present invention relates to a ladder accessory such as a shelf or tray assembly, more specifically, to a ladder accessory for holding materials, supplies, paint, equipment or tools. The ladder accessory of this invention is capable of being removably mounted on a ladder and, in certain of its specific aspects, relates to a partly covered tray for holding paints or other liquids.

2. Related Art

Many workers, and in particular, painters and carpenters, work from a ladder or scaffold so that the work can be performed at an elevation above ground level. It is important to have available at a convenient position the necessary materials, supplies and tools, and an inconvenient location of these can be time consuming, annoying, and even hazardous. It is customary for workers to use a platform or tray, such as a paint tray, and the prior art discloses a number of different trays that are mountable to a ladder so that the tray and the materials thereon or therein are conveniently located for the worker. In this manner, a tray holding paint, brushes, rollers, scrapers, other equipment or tools and the like, can be mounted on the ladder and be supported thereby close to the worker. The position of the tray along the ladder may be changed to suit the convenience of the worker.

For example, U.S. Pat. No. 3,822,846 to H. R. Jesionowski discloses a paint tray that can be mounted on the side of a ladder by means of a boss which extends outwardly from the tray and cooperates with a hook member for engagement with the step or rung of the ladder.

U.S. Pat. No. 3,829,051 to G. H. Emmons discloses a tray for paint and other materials and tools mountable on the side of a ladder by a plurality of adjustable hook members that engage the rail and rungs of the ladder.

U.S. Pat. Nos. 3,495,683 to O. C. Broden, 4,489,911 to J. Riley, 4,660,794 to W. B. Given and 4,662,594 to R. Dubis disclose work trays capable of being mounted to the side of a ladder having hollow rungs.

The trays shown in the above prior art can be oriented horizontally only, and all require more or less complicated adjustable locking arrangements. Further, these patents fail to disclose trays that can be supported on a ladder when in use in a position which is other than horizontal, i.e, positioned vertically or generally parallel to the ladder side rails, and yet provide ample storage for working materials or supplies, including liquid materials such as paint.

U.S Pat. No. 2,686,032 to E. Thorson discloses a paint pail support comprising an L-shaped platform fitted with a closeable strap to secure a paint pail on the platform, and having hook means to hang the support on a rung, inside the side rail of a ladder.

British Patent 1,512,155 discloses a ladder attachment comprising a flat platform which fits over rungs of a ladder to provide a platform on which a worker may stand.

SUMMARY OF THE INVENTION

Generally, the ladder accessory of the present invention provides a device that can be mounted on the rung of a ladder, such as an extension ladder or a step ladder, and oriented in alignment with the side rails of the ladder when in use, to be positioned at a convenient and safe location for the worker. The ladder accessory of the present invention can be mounted or attached in-line with, i.e., generally parallel to, the ladder side rails and on the outside of the ladder, thereby making use of the tray assembly safe for the workman by not obstructing the ladder rungs or treads.

Specifically, in accordance with the present invention there is provided a ladder accessory dimensioned and configured for mounting on a ladder having spaced side rails and a plurality of spaced parallel rungs connected thereto. The accessory comprises a support fixture and mounting means on which the support fixture is carried. (The support fixture may comprise a shelf member, a tray assembly as defined below, or some other fixture.) The mounting means comprises a bracket member having flange means transversely spaced from the fixture and defining a shoulder recess which is dimensioned and configured to receive a side rail of the ladder. The flange means terminate in at least one recessed profile defining at least one downwardly-facing hook at the upper end of the accessory, which hook is dimensioned and configured to engage a rung of the ladder. In this way the accessory can be removably mounted on the ladder with the shoulder recess engaging a side rail of the ladder, the hook engaging a rung of the ladder, and the fixture disposed laterally outwardly of the ladder.

In one aspect of the present invention, the flange means terminate in a pair of hooks spaced apart from each other a distance such that each hook engages a respective one of the rungs of the ladder.

In another aspect of the invention, the recessed profile of at least the uppermost of the hooks defines a distal claw, an arcuate center section, and a wing section extending beyond the arcuate section and defining a catch on the distal claw.

In accordance with another aspect of the present invention there is provided a ladder accessory dimensioned and configured for mounting on a ladder having spaced side rails and a plurality of spaced parallel rungs connected thereto. The ladder assembly comprises a support fixture comprising a tray assembly having (i) a tray having a tray floor and a continuous peripheral wall projecting transversely of the floor and terminating in a marginal rim of the peripheral wall, the peripheral wall extending about at least a portion of the periphery of the tray, and (ii) a cover affixed to the marginal rim of the peripheral wall and thereby spaced from the tray floor. The tray and cover may each be generally rectangular in shape, and the cover cooperates with the floor and the peripheral wall to define therewith a reservoir having therein an access opening defined between the tray floor and the cover. Mounting means, on which the support fixture is carried, are dimensioned and configured to engage a ladder for mounting the ladder accessory on the ladder with the access opening at the top of the reservoir.

In accordance with another aspect of the present invention, the cover of the tray assembly contains a first element of a disengageable seating means and the marginal rim of the peripheral walls contains a second element of the disengageable seating means, the seating means being dimensioned and configured to enable mounting and de-mounting of the cover on the tray assembly, for example to provide a liquid-tight seal between the cover and the tray.

Another aspect of the invention provides for the support fixture to be detachable from the mounting means.

Other aspects of the invention will be apparent from the following description.

BRIEF DESCRIPTION OF THE DRAWINGS

FIG. 1A is a partial section view taken along line A—A of FIG. 1;

FIG. 1C is an enlarged view in perspective of a screw-cap closing an opening in the cover of the tray assembly of FIG. 1;

FIG. 1D is an end view in elevation of the paint roller of FIG. 1;

FIG. 3 is a perspective view of the tray assembly of FIG. 1;

DETAILED DESCRIPTION OF THE INVENTION AND SPECIFIC EMBODIMENTS THEREOF

Figure 1:
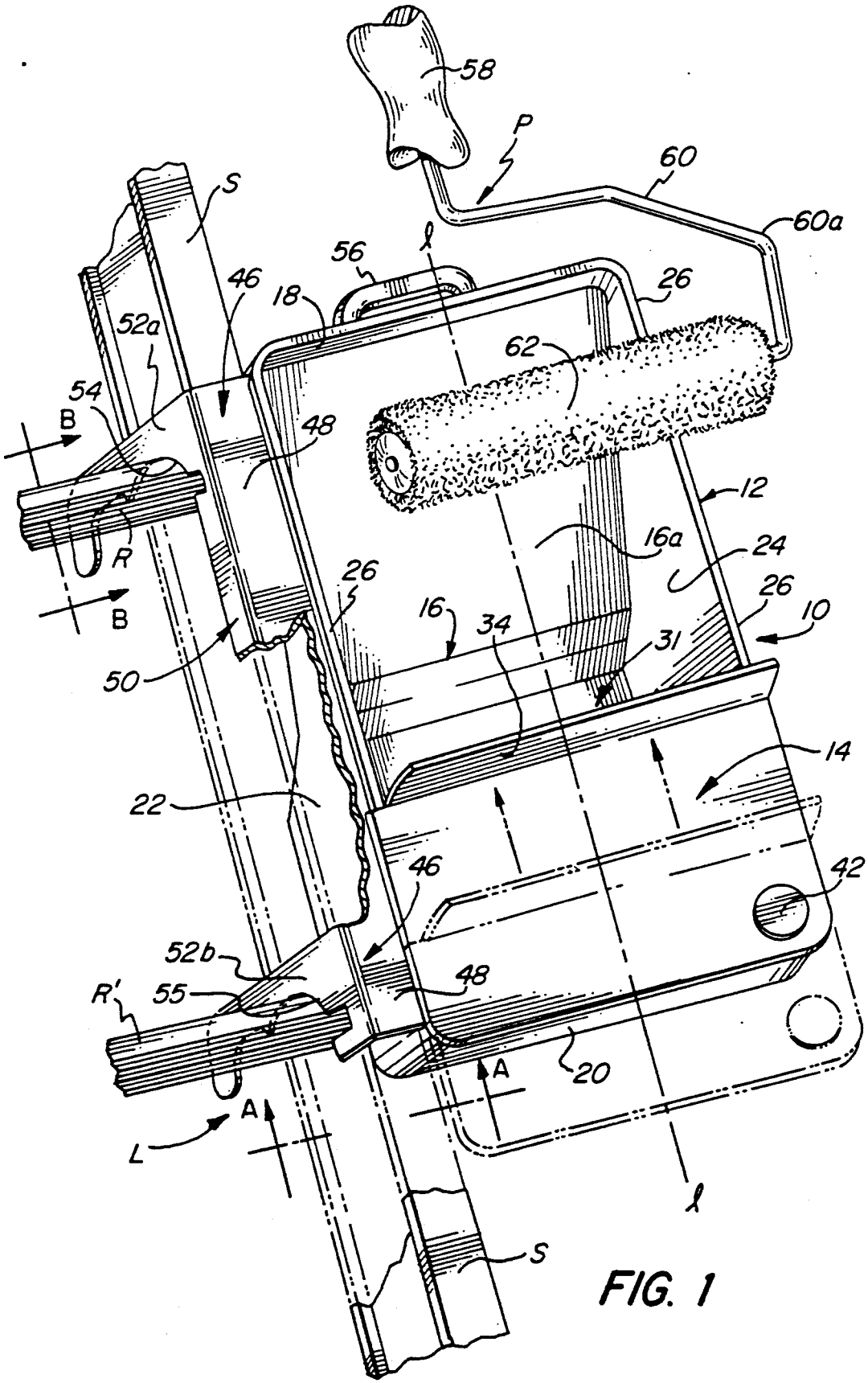
FIG. 1 is a perspective view with parts broken away of one embodiment of the ladder accessory of this invention comprising a tray assembly mounted on a ladder, the ladder being shown with parts broken away and partly in phantom, and further showing a paint roller being used with the tray.

In a specific embodiment, the ladder accessory of the present invention may comprise a tray assembly in which the support fixture comprises a substantially rectangular tray having opposed end walls and side walls extending upwardly from the bottom and terminating in a marginal rim which projects transversely from the walls. A cover is provided for at least a portion of the tray, and opposite marginal edges of the cover and a third marginal edge extending between the opposite marginal edges are suitably dimensioned and configured to engage the rim in which the peripheral walls of the tray terminate, preferably in liquid-tight engagement. Thus, the aforesaid marginal edges of the cover may be turned downwardly and then reversely turned inwardly in overlapping relation to itself to form a recess. The rim of the tray along its opposed side walls is seated in the recess for slidable engagement of the cover on the rim. The rim of the tray along the one end wall is dimensioned and configured to frictionally engage the recess formed at the third marginal edge of the cover. In this manner, the cover tightly engages the tray along the rim and is in a locked position when all three sides at the recesses engage the corresponding three sides of the rim. When the reservoir contains a liquid such as paint, the tight fit prevents the paint from leaking from the tray or its reservoir, as explained in greater detail below. The cover, however, is in slidable engagement with the tray, and the cover may be slid to an open position to allow access to the reservoir, for example, for refilling the tray with paint, or to facilitate cleaning of the tray assembly.

Referring now to the drawings, there is shown the ladder accessory of this invention comprising a tray assembly indicated generally by the numeral 10. Although the embodiment shown and described in detail is particularly useful as a paint tray, it should be understood that the tray assembly can be used for holding other materials, supplies and tools. The tray assembly comprises a tray 12 and a cover 14, and, as shown, is of substantially rectangular configuration, e.g., square or oblong. Tray 12 has a floor 16, and a peripheral wall projecting transversely of floor 16 and comprised, in the illustrated embodiment, of opposed end walls 18 and 20 and opposed side walls 22 and 24. The peripheral wall extends about the periphery of tray 12 and terminates in a rim 26. Each of the walls 18, 20, 22 and 24 is substantially normal to the plane of floor 16 and extends therefrom to provide an open, recessed tray configuration to tray 12. Rim 26 projects transversely from the top marginal edge of the walls 18, 20, 22 and 24 and extends along the entire length thereof. It will be appreciated that the rim need not extend completely around the peripheral walls as shown but, for example, may be eliminated from end wall 18. In the illustrated embodiment however, the rim 26 does extend completely around the tray at the top of the end walls thereof.

Figure 2:
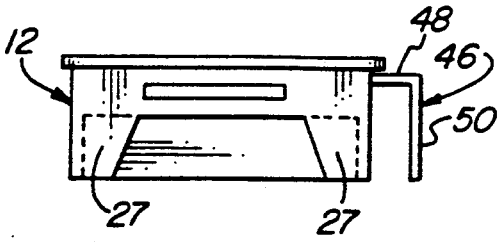
FIG. 2 is an end view in elevation of the tray assembly of FIG. 1.

Floor 16 of tray 12 is inclined relative to rim 26 of walls 18, 20, 22, 24 to provide a reservoir 17 (FIG. 3) at one end thereof, reservoir 17 being deeper than the portion of tray 12 defined by platform section **16*a* of floor 16. Reservoir 17 is located beneath the cover 14 (described in more detail below) such that when the tray assembly is mounted on a ladder and oriented vertically or merely inclined with end wall 18 raised above opposite end wall 20, the reservoir is at the bottom or lower end of the tray assembly 10. A paint tray is typically provided with an inclined platform (as at 16*a* in the illustrated embodiment) so as to increase the volume of the tray for holding a greater volume of paint and to allow for the roller or brush to drain paint back to the deeper, reservoir zone of the tray when the tray is positioned horizontally. The tray assembly 10 is similarly provided with a reservoir but one which is covered by a liquid-tight cover 14 positioned over the reservoir 17 making it possible not only to hold more paint but to enable positioning of the paint-containing tray assembly as illustrated in FIG. 1, at or close to vertically. The substantially flat platform 16*a* of floor 16 extends on an incline or slope upwardly from the reservoir 17 to the open end 12***a* of the tray (see FIGS. 1 and 3), which is provided with legs 27 (FIG. 3) for supporting open end 12*a* of the tray and orienting it in a substantially horizontal position when tray 12 is lain flat as on a horizontal platform, as shown in FIG. 2, for use or storage. The inclined platform section 16*a* of floor 16 provides a means for draining excess paint from a paint roller P (FIG. 1) as it is pulled from the reservoir 17, and the paint then drains back into the reservoir. Where desired, the platform section 16*a* may be provided with one or more ribs, channels or corrugations (not shown) to facilitate draining excess paint from the paint roller P.

Generally, materials and tools can be held in the reservoir 17 (FIG. 3), or an ample supply of paint or other liquid may be contained within the reservoir 17, which has an access opening 31 which provides the painter with easy access to the reservoir with the application of a paint roller or brush. An inclined platform section of the tray floor extends from the reservoir to the open end of the tray assembly. This inclined platform provides a useful and convenient wiper/drain means for any excess paint as a brush or roller is pulled from the reservoir.

Figure 4:
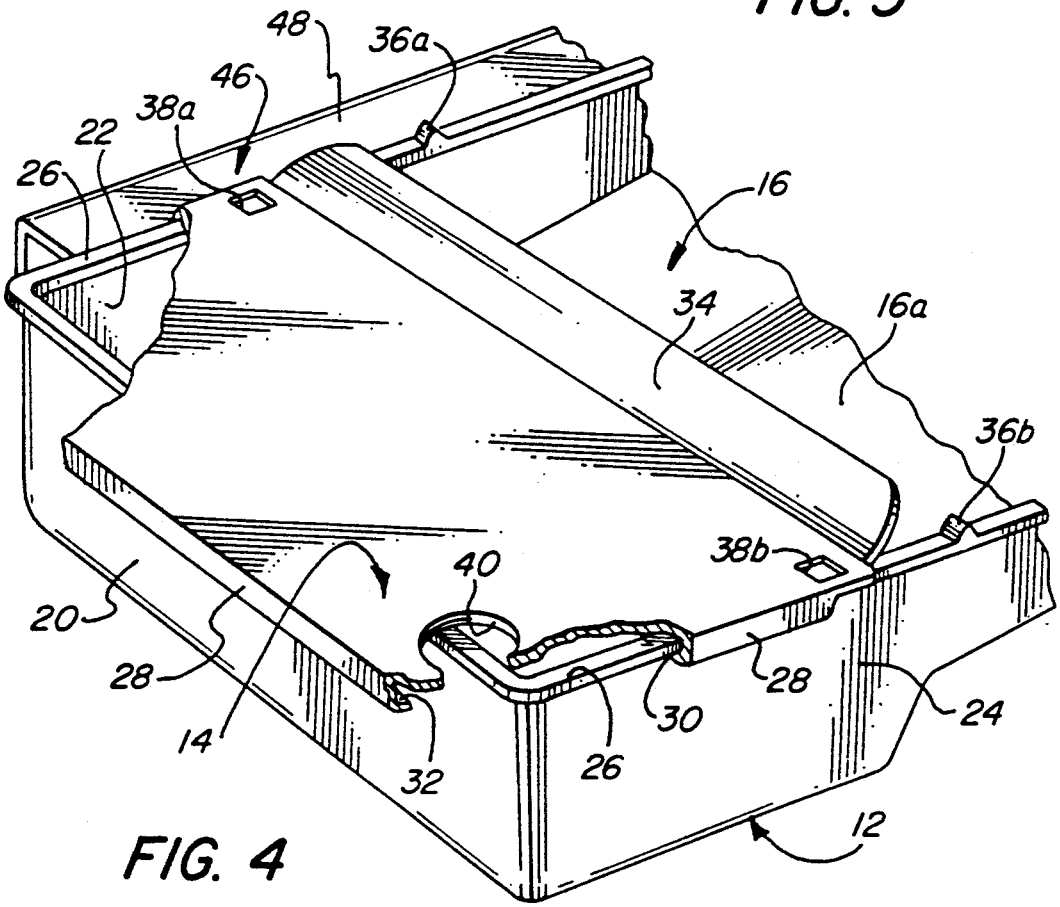
FIG. 4 is a perspective view of a portion of the tray assembly of FIG. 1 with the cover partially broken away and shown in a partially-mounted position.

At least a portion of the tray 12 is covered by cover 14, and in a preferred embodiment, the cover extends over the reservoir portion 17 only. As shown in FIG. 4, three marginal edges of the cover 14 are turned downwardly at 28 and then inwardly at 30, thereby forming a groove 32, which is dimensioned and configured for tight, friction-fitting slidable engagement with rim 26 projecting from the side walls 22, 24 and end wall 20. It will be observed that when the rim 26 seats in groove 32 along the end wall 20, which would be the bottom wall of the reservoir when the tray is oriented either vertically or otherwise with end wall 18 raised above end wall 20, the rim 26 frictionally engages the groove 32 and helps to lock the cover 14 in place leaving an access opening 31 (FIG. 1) between the end of cover 14 which carries flange 34, and tray floor 16 (FIG. 3). Groove 32 and rim 26 cooperate to provide a seating means enabling removable seating of cover 14 on tray 12.

In addition to the frictional engagement between the cover groove 32 and the rim 26 of the tray 12, there is provided as part of the seating means a cover locking means comprising, in the illustrated embodiment, protuberant spurs 36*a*, 36*b* (FIG. 4) on rim 26 of, respectively, opposed side walls 22 and 24. Complementary openings 38*a*, 38*b* are formed at or adjacent the opposed marginal edges of the cover 14. Each opening 38*a*, 38*b* is dimensioned and configured to be registerable with the corresponding one of spurs 36*a*, 36*b*. In FIG. 1, cover 14 is shown in phantom outline in its partially mounted position on tray 12, with the rim 26 on opposite side walls 22, 24 engaged by groove 32 but the rim 26 on end wall 20 is not yet seated in groove 32. In the partially-mounted position of cover 14 shown in phantom outline, spurs 36*a*, 36*b* are not yet seated in openings 38*a*, 38*b*. When the cover 14 is moved to its closed position as by sliding the cover in the direction of the dash-line arrows in FIG. 1, spurs 36*a*, 36*b* seat in corresponding openings 38*a*, 38*b*. In this manner, the cover is securely locked into position to help provide a liquid-tight seal between cover 14 and tray 12. The resultant tight fit prevents paint from leaking from the reservoir when the tray assembly is oriented vertically and the marginal rim 26 and the groove 32 are dimensioned and configured to enable mounting and demounting of the cover 14 on the tray 12.

At its open end adjacent access opening 31, the cover 14 is provided with an outwardly turned (relative to reservoir 17) flange member 34, as best seen in FIGS. 1, 3 and 4, which serves as a grip for grasping by the worker to slide the cover back and forth for mounting and removal. Generally, it is seen that the cover 14, along three marginal edges thereof, is turned downwardly and then reversely turned inwardly in overlapping relation to itself to form the groove 32, and has the upwardly turned flange 34 formed along its fourth marginal edge. Access opening 31 provides access to reservoir 17 for emplacement therein and removal therefrom of materials, tools, etc., including liquids such as paint. Thus, paint roller P or a paint brush (not shown) may be dipped into paint or other liquid contained within reservoir 17 with tray assembly 10 mounted on ladder L as shown in FIG. 1. Excess paint may be removed from the applicator (the cylinder 62 of paint roller P—FIG. 1D—or the bristles of a paint brush) by wiping the applicator against flange 34 and/or platform 16*a* of floor 16.

The tray assembly 10 is seen to provide a ladder accessory including a tray 12 providing a reservoir 17 having an access opening 31 at the top thereof when the tray assembly 10 is oriented in an upright position, e.g., vertically, thereby allowing easy access to the materials or supplies, such as paint, contained in the reservoir 17.

Where desired, the cover 14 may be provided with a suitable drain means for emptying the reservoir of unused paint or other liquid, such as a cleaning liquid, or the like. The cover 14 is, in such case, provided with a threaded aperture 40 (FIG. 4) adjacent the marginal edge thereof which is to be fitted over end wall 20. A plug 42 (FIG. 1C) has a threaded shank 44 for threaded engagement with aperture 40. The secure threaded engagement of plug 42 prevents leakage, but the reservoir 17 can be easily drained when the plug 42 is removed. This facilitates draining unused liquid from reservoir 17 into a container, after which cover 14 may be removed for additional removal of liquid and to facilitate cleaning.

The tray assembly 10 can be mounted along either side rail of a ladder L (FIG. 1) and attached to two parallel rungs R, R′ thereof by means of a mounting means indicated generally at 46 (FIGS. 1, 1A and 3). The mounting means 46 includes a shoulder 48 (FIGS. 1, 3 and 4) extending transversely from one of the side walls 22 of the tray, and a downwardly bent flange member 50 comprised of a pair of flange sections 52*a* and 52*b* which lie in a common plane which is substantially perpendicular to the plane of cover 14 when the latter is mounted upon tray 12 as described above. The shoulder 48 extends outwardly from the side wall 22 below the rim 26 and flange sections 52*a*, 52*b* are substantially parallel to side wall 22. Each flange section 52*a*, 52*b* is provided with respective hook openings 54 and 55 (FIG. 3), which are in a common plane with the flange member 50 and therefore with sections 52*a*, 52*b*. The side wall 22 of the tray 12, shoulder 48 and flange sections 52*a* and 52*b* cooperate to form mounting means 46 which is dimensioned and configured for engagement with the side rail S of ladder L. Cut-out hooks 54 and 55 engage the rungs R, R′ of the ladder L as shown in FIG. 1. For a typical ladder, the rungs R, R′ are spaced 12 inches apart, so the hook openings 54, 55 are likewise spaced 12 inches apart. As shown in FIGS. 1 and 1A, the tray assembly can be easily manipulated onto the ladder by seating the shoulder 48 of mounting means 46 on the side rail S of ladder L and hooking the flange sections 52*a*, 52*b* to, respectively, the rungs R, R' so as to depend therefrom and be supported thereby. In this manner, the tray assembly 10 is oriented essentially parallel to the side rails S (only one of which is shown in FIG. 1) of the ladder L. That is, the longitudinal axis 1—1 (FIG. 1) of tray assembly 10 lies parallel to the side rails S of ladder L when the tray assembly is mounted as shown in FIG. 1. Given the position in which a ladder is used, this will usually place the tray assembly 10 vertically, or closer to vertically than horizontally, with the access opening 31 facing upwardly.

Figure 1B:
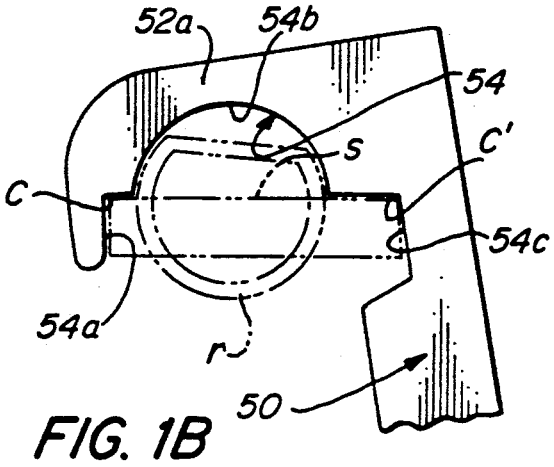
FIG. 1B is a partial view in elevation taken along line B—B of FIG. 1.

Referring to FIG. 1B, the hook opening 54 in flange section 52*a* is shown in detail and is seen to have in profile an arcuate center section 54*b* of approximately semicircular configuration, and radially opposite (relative to the arcuate section) wing sections 54*a*, 54*c* extending beyond the arcuate section and defining corner-like hooks c, c' which, in the illustrated embodiment, define substantially right-angle corners. The resultant profile of the hook openings 54, 55 enables them to seat both on the cylindrical or flattened cylindrical rung R of a ladder, and the tread-step s of a step ladder. (Rung R and tread-step s are shown in phantom outline in FIG. 1B.) The tray assembly 10 may thus be conveniently used on both the rungs of ladders such as extension ladders, and the tread-step of step ladders.

Thus, it is seen that, generally, the tray assembly may be suspended from a ladder by means of mounting means comprising a bracket having a pair of spaced-apart hooks depending from a shoulder which extends transversely from one of the side walls of the tray, preferably from below the rim. The shoulder may be provided with downwardly bent flange sections that are preferably substantially parallel to the side wall of the tray. The recess formed by the side wall, shoulders and flanges provides a seating arrangement for the side rail of the ladder. Each flange section lies in a common plane and terminates in a hook recess or cut-out of the flange sections which opens in a downward-facing direction when the tray is oriented vertically. In this manner, each hook member engages a ladder rung or tread-step and, with the shoulder seated on the side rail, the tray assembly is oriented substantially parallel to the ladder side rails when in use. The tray assembly extends to the outside of the ladder, thereby not obstructing the rungs or tread-steps and providing easy access to the materials, such as paint.

On the other hand, under some work circumstances, it may be desirable to orient the tray assembly in a horizontal position, as upon a scaffold platform. To facilitate such use, the flange sections of the bracket member may terminate in foot edges which are substantially co-terminal with the bottom of the tray, that is, the foot edges lie in substantially the same plane as the exterior of the tray floor. When the tray assembly is oriented horizontally, the flange sections thus act as additional legs thereby helping to stabilize the tray assembly. Thus, in the illustrated embodiment of the invention, flange sections 50, 52 and legs 27 are substantially co-terminal with the exterior of the floor 16 of the tray 12 as shown in FIG. 2, showing tray 12 supported on a horizontal surface (un-numbered) for use as a conventional paint tray.

The tray 12 is provided with a handle 56 extending from end wall 18. The handle facilitates carrying the tray assembly 10 even when the reservoir 17 contains paint, and to lift the tray assembly from one rung to another when depending from a ladder in a position of use. After use, or during use, the tray assembly 10 can be stored vertically by suspending it by the handle 56, or the tray assembly 10 can be stored flat.

FIG. 1 in particular illustrates the tray assembly mounted on a ladder, seated on one side rail and depending from two spaced apart rungs R and R'. The tray assembly 10 in this elevated use position, provides easy access to paint in the reservoir 17 by means of a roller P (which itself is not part of the invention), and the platform section 16*a* permits excess paint to drain from the roller back into the reservoir 17. Thus, it will be observed that the tray assembly of the invention provides utility, convenience, versatility, and safety.

The paint roller P, as shown in FIG. 1D, has a roller handle 58, an axle bar 60 and an applicator cylinder 62. Axle bar 60 is bent at juncture 60*a* to displace applicator cylinder 62 from handle 58 so as to facilitate entry of the applicator cylinder 62 through access opening 31 and into reservoir 17.

Figure 5:
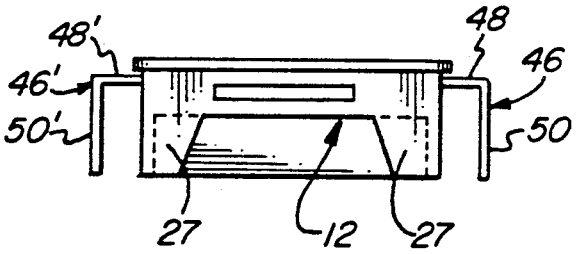
FIG. 5 is a view corresponding to FIG. 2 of another embodiment of the present invention.

Referring now to FIG. 5, there is shown another embodiment of the invention which is identical to that illustrated in FIGS. 1–4, except for the addition of a second mounting means 46' thereto. Thus, the identical components of the embodiment of FIG. 5 are identically numbered to those of the embodiment of FIGS. 1–4. The second mounting means 46' is the mirror image of the mounting means 46 and comprises a shoulder 48' and flange sections, only one of which, flange section 50', is visible in FIG. 5. The mounting means 46' is affixed to the side wall 24 opposite the side wall 22 to which the mounting means 46 is affixed. The embodiment of FIG. 5 is used identically to the embodiment of FIGS. 1–4, but it has the capability of being mounted exteriorly of the ladder rungs on either of the two side rails S of the ladder L, so as to accommodate a left-handed as well as a right-handed worker. Both the embodiments of FIGS. 1–4 and of FIG. 5 could, of course, be mounted between the side rails but, usually, that is not a convenient practice and may be unsafe in some circumstances.

Figure 6:
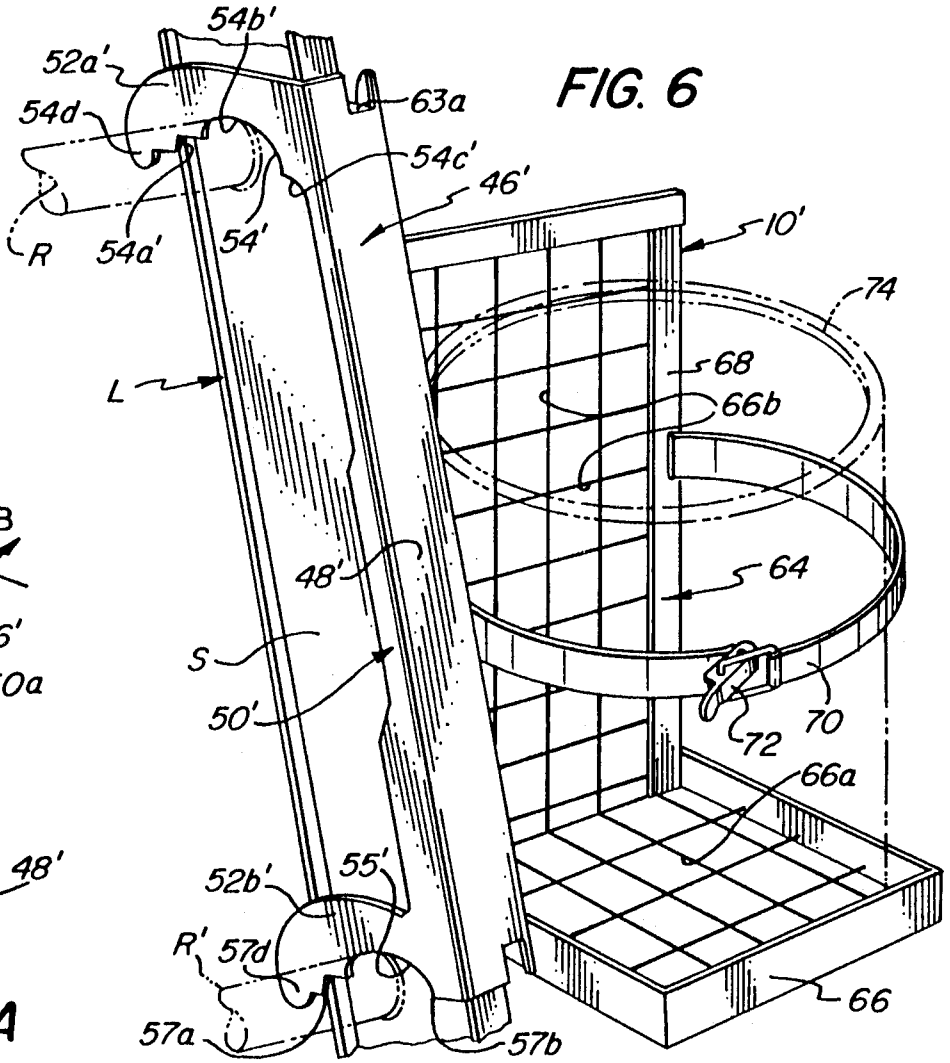
FIG. 6 is a perspective view of a second embodiment of the ladder accessory of this invention comprising a shelf member mounted on a ladder (shown with parts broken away and partly in phantom)
Figure 6A:
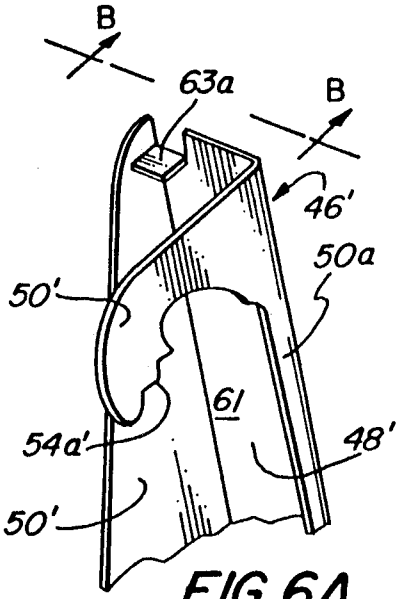
FIG. 6A is a perspective view of the upper portion of the mounting means of the accessory of FIG. 6.
Figure 6B:
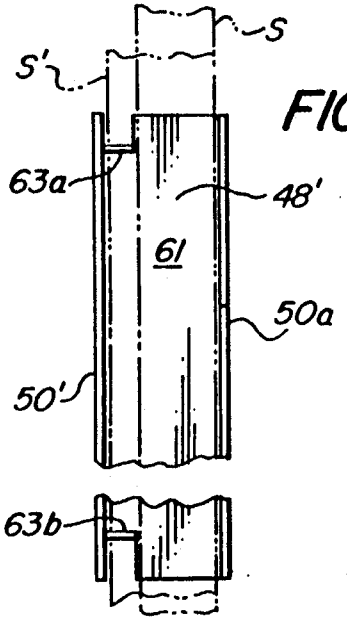
FIG. 6B is an end view taken along line B—B of the mounting means shown in FIG. 6A.

Referring now to FIG. 6 there is shown another embodiment of the present invention, one in which the support fixture comprises a shelf member. Parts of the embodiment of FIG. 6 which correspond to the embodiment of FIGS. 1–4 are identically numbered except for the addition of a prime indicator thereto. Thus, the ladder accessory of FIG. 6 comprises a shelf assembly 10' comprised of a mounting means shown generally at 46' and comprising a shoulder 48' and flange member 50' and an opposed flange member 50*a* (FIGS. 6A and 6B; flange member 50*a* is not visible in FIG. 6). Flange members 50' and 50*a* and shoulder 48' cooperate to define therebetween shoulder recess 61. (FIGS. 6A and 6B). Flange member 50' is comprised of flange sections 52*a'* and 52*b'*. Each flange section 52*a'*, 52*b'* is provided with respective hook openings 54' and 55'. The hook openings 54' and 55' are configured generally similarly to hook openings 54 and 55 of the embodiment of FIGS. 1–4 and therefore a detailed description is not given. However, it should be noted that hook openings 54' and 55' in profile provide an arcuate center section 54*b'* corresponding to 54*b* of the FIG. 1B embodiment with oppositely disposed wing sections 54*a'* and 54*c'* corresponding to wing sections 54*a* and 54*c* of the embodiment illustrated in FIG. 1B. In the embodiment of FIG.

6, however, it should be noted that wing section 54a', as best seen in FIG. 6A, is cut in a double-step configuration so as to permit hook opening 54' to accommodate two different standard widths of step ladder tread-steps. It should also be noted, as best seen in FIG. 6, that the lower hook opening 55' has a similar double-stepped wing section 57a but that the opposite wing section 57b is simply cut away. This is because in order to securely mount the mounting means on the ladder L, or on a step ladder, it is necessary only for the rear wing sections 54a' and 57a to the rungs R,R' as the weight of the device will exert a forward-pivoting pressure on the accessory, thereby engaging the rear hooks 54d and 57d with their respective associated rungs R, R'. However, the provision of forward wing sections 54c (FIG. 1B) and 54c' (FIG. 6) may provide a somewhat more secure engagement of the device with the ladder L. To that extent, it is preferred to provide a hook opening having a profile such as that of FIG. 1B or such as that of hook opening 54' of FIG. 6, at least at the uppermost of the two hook openings. (In this specification and in the claims, the "uppermost" hook opening is the one which is the upper one when the ladder accessory is mounted on a ladder as shown in FIGS. 1 and 6.)

Referring now to FIGS. 6A and 6B mounting means 46' is seen to have extending transversely therefrom a flange member 50' which cooperates with shoulder 48' to define therebetween a shoulder recess 61 within which the side rail S of ladder L is received as best seen in FIGS. 6 and 6B (and as seen in FIG. 1 with respect to the embodiment of FIGS. 1–4). Referring jointly to FIGS. 6, 6A and 6B, a pair of spacer shims 63a, 63b are formed in shoulder 48'. As will be best appreciated with respect to spacer shim 63a shown in FIG. 6A and 6B, the spacer shims 63a and 63b may be formed by making a pair of parallel cuts in shoulder 48' at each of the opposite ends thereof, one cut being adjacent to flange member 50 and the other spaced therefrom, and then bending the resultant tab into shoulder recess 61. The provision of spacer shims 63a and 63b enables the mounting means 46' to accommodate ladder side rails of different width. Thus, referring to FIG. 6B, there is shown in dot-dash outline a ladder side rail S which is narrow enough to fit in the space between the inside of flange member 50a and the inside edges of the spacer shims 63a and 63b. With this arrangement, the side rail S would fit flush against the inside wall of shoulder 48'. In this way, the mounting means 46' can be used with light weight or household extension ladders. If industrial type extension ladders having wider side rails S' (FIG. 6B) are to be employed, the wider side rail S' will extend between the insides of flanges 50' and 50a and will rest on spacer shims 63a, 63b, which will space the side rail S' a short distance from the inside of shoulder 48'. Accordingly, the spacer shims 63a and 63b serve to define within shoulder recess 61 a first side rail recess (unnumbered) within which the narrower side rail S may be received and a second side rail recess (unnumbered) within which the wider side rail S' may be received. Thus, the first side rail recess which is sized to receive side rail S is narrower and deeper than the second side rail recess which is sized to receive side rail S'.

In the embodiment of FIG. 6, the ladder accessory 10' comprises a support fixture comprising, in the illustrated embodiment, a shelf member 64 comprised of a horizontal ledge or shelf 66 and a backpiece 68 which extends at a right angle to horizontal ledge or shelf 66. In the illustrated construction, horizontal ledge or shelf 66 and backpiece 68 are comprised of respective metal frames to which are affixed rigid wire grids 66a, 66b in order to provide a rigid, strong construction which is of relatively light weight. A securement strap 70 is affixed to backpiece 68 and is equipped with a latch 72 which may be opened so that a container such as a conventional paint can 74, shown in dash outline in FIG. 6, may be secured to shelf member 64 by means of securement strap 70. In use, a paint can 74 is secured to shelf member 64 by means of securement straps 70, and the ladder accessory 10' may be lifted together with the paint can 74 simply by grasping the paint can handle 76 to carry the ladder accessory up the ladder and mount it thereon by means of the hook openings 54', 55'. As with the embodiment of FIGS. 1–4, the support fixture and whatever material supplies or tools are affixed thereon, are disposed outwardly of the ladder L, that is, shelf member 64 is not disposed between the side rails of the ladder but outwardly thereof where it will not interfere with movement of the worker on the ladder or pose a safety hazard should the worker decide to climb up the ladder past the point at which the ladder accessory 10' is mounted on the ladder. More significantly perhaps, when the worker desires to move the ladder accessory 10' from one position on the ladder to another, he need not stay below the accessory while he lifts it off as he would have to if the shelf member 64 were disposed between the side rails of the ladder but he may stand at any convenient point on the ladder and move the device by reaching to outwardly of the side rail S.

Figure 7:
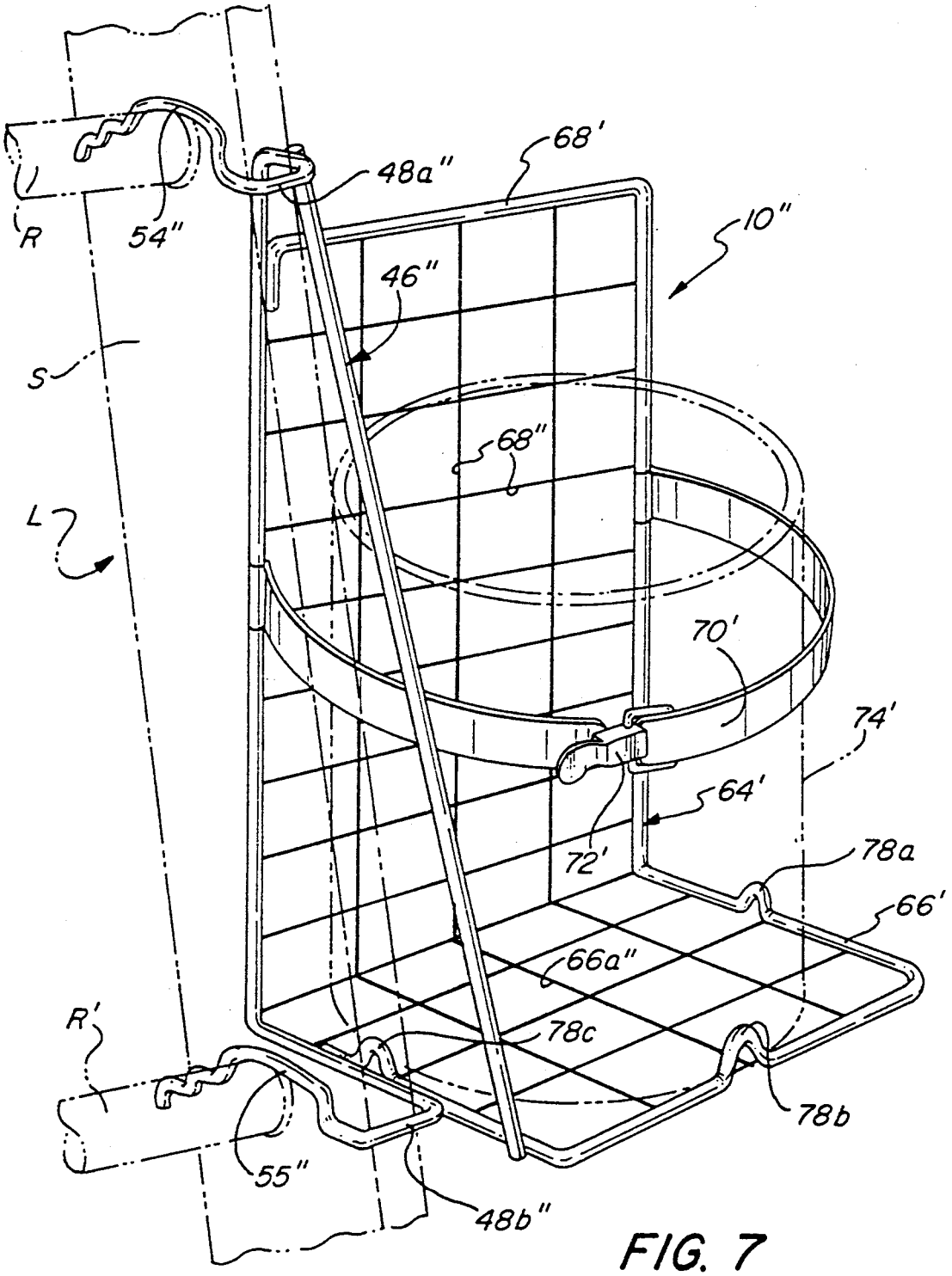
FIG. 7 is a perspective view of a third embodiment of the ladder accessory of this invention comprising a shelf member, the accessory being mounted on a ladder, the ladder being shown with parts broken away and in phantom outline.

It will be apparent that numerous variations may be made to the specific embodiments illustrated in the drawings. For example, reference is made to FIG. 7 which shows an alternate construction of a ladder accessory. The components of FIG. 7 which correspond to those of the embodiment of FIGS. 1–4 are identically numbered thereto, except for the addition of a double prime indicator; the components of FIG. 7 which correspond to the components of the embodiment of FIGS. 6–6B are identically numbered thereto, except for the addition of a single prime indicator. Accordingly, the structure of the ladder accessory illustrated in FIG. 7 will not be described in detail, as it will be apparent that the component parts thereof provide the same essential structure as illustrated in the other embodiments. Thus, ladder accessory 10" is of wire frame construction comprising a mounting means 46" formed of heavy gauge, rigid wire, in a shelf member 64" of similar heavy gauge, stiff wire or rod construction. As in the embodiment of FIGS. 6–6B, the shelf member 64" comprises a horizontal ledge 66" and a backpiece 68", each of which has a respective stiff wire grid 66a" and 68a" to provide a lightweight yet sturdy construction of shelf member 64". A pair of hook openings 54" and 55" are provided by a wire rod bent to provide an arcuate center, extending stepped-wing profile similar to that of the hook members of the FIGS. 6–6B embodiment. It will thus be appreciated that the profile of the hook means can be provided by bent rod or wire construction. Horizontal ledge 66' is formed with bent portions 78a, 78b and 78c in respective ones of the three sides thereof opposite and adjacent to backpiece 68'. Bent portion 78a, 78b and 78c are formed at approximately the mid-point of the respective sides of horizontal ledge 66' and serve to help secure in place a container such as paint can 74', shown in dash outline of FIG. 7.

A shoulder portion is provided by the bent portions 48a" and 48b" which extend transversely of shelf member 64". A securement strap 70' fitted with a latch 72' is also provided, in a manner analogous to that of the embodiment of FIGS. 6–6B.

Figure 8A:
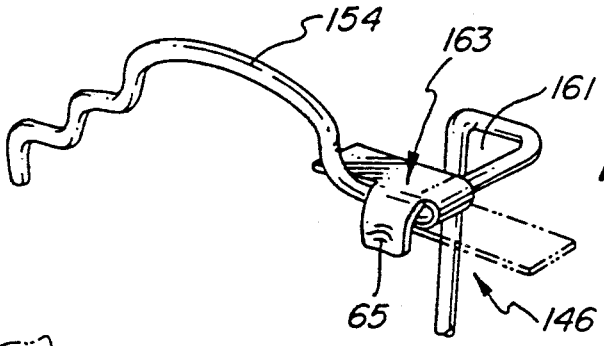
FIG. 8A is a view of the upper-most portion of the mounting means of the accessory of FIG. 8, showing an adjustable spacer-shim mounted thereon.
Figure 8:
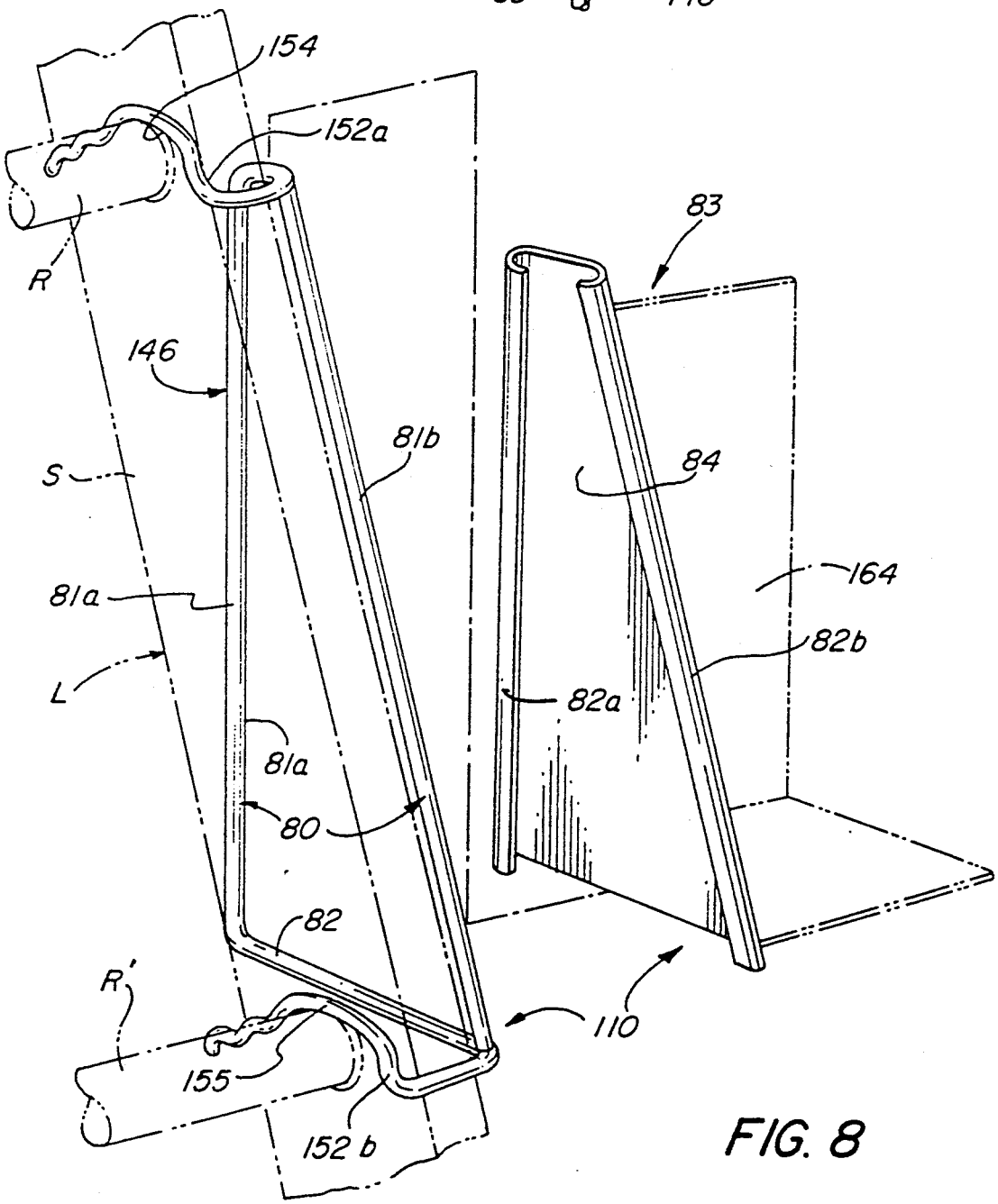
FIG. 8 is a perspective exploded view of a fourth embodiment of the ladder accessory of this invention, in which a support fixture is detachable from its associated mounting means, the mounting means being mounted on a ladder shown in phantom outline and with parts broken away, and a portion of the support fixture being shown in dash lines.

Referring now to FIG. 8, there is shown yet another embodiment of the present invention in which the components thereof which correspond to those of the embodiments of FIGS. 1–6B are identically numbered thereto, except for the addition of the digit 1 before the number. Thus, FIG. 8 shows a ladder accessory 110 of wire frame construction comprising a mounting means 146 which, like the embodiment of FIG. 7, may be formed from rod or stiff, heavy guage wire construction. In this embodiment, the support fixture, which comprises a shelf member 164, is detachable from the mounting means 146. The shelf member 164 is partly shown in dash line outline and is dimensioned and configured to be removably fastened to mounting means 146 by any suitable fastening means. Mounting means 146 may thus serve as a mounting means to which any suitable support fixture, such as shelf member 164, may be attached. Mounting means 146 is seen to include a flange means comprised of flange sections 152*a*, 152*b*, each being dimensioned and configured to define a respective hook openings 154, 155. The hook openings 154, 155 are dimensioned and configured as described in detail above with respect to the other embodiments, to provide (at least at the uppermost flange section 152*a*, and preferably at both the uppermost flange section 152*a* and the lowermost flange section 152*b*) an arcuate profile including a wing extension which enables the hook openings 154, 155 to engage the rungs R and R' of a ladder L upon which the ladder accessory 110 is mounted.

Mounting means 146 includes a generally triangular hanger means 80 which is comprised of rods 81*a*, 81*b* and cross-rod 82, rods 81*a* and 81*b* being connected at their lowermost portions by cross-rod 82. Rods 81*a*, 81*b* and cross-rod 82 are, in the illustrated embodiment, arranged in a profile of a right angle triangle which is truncated at its uppermost portion, rod 81*a* providing the truncated altitude leg of the triangle and rod 81*b* providing the truncated hypotenuse leg. Cross-rod 82 provides the base of the truncated right angle triangular configuration.

The support fixture 83 comprises a shelf member 164 (shown in dash outline) and includes a mounting plate 84 which, like hanger means 80, is of generally truncated right angle-triangular configuration in profile and has a pair of turned-back flanges 82*a*, 82*b* extending along the two opposed major lengths thereof. Turned-back flange 82*a* extends along the truncated altitude leg of the triangle, and turned-back flange 82*b* extends along the truncated hypotenuse leg of the triangle. Mounting plate 84 may be fitted over mounting means 146 as indicated by the dot-dash line in FIG. 8A, and readily removed therefrom when desired. Thus, the ladder accessory of the present invention may be provided in the form of a mounting means 146 plus a plurality of support fixtures, of which support fixture 83 is exemplary, each of the support fixtures including a standard mounting plate 84 so that different support fixtures may be mounted upon the same mounting means.

Referring now to FIG. 8A, there is shown the upper portion of the mounting means 146 having a movable spacer shim 163 mounted thereon. Spacer shim 163 is mounted for pivoting movement between an engaged position shown in solid line in FIG. 8A and a disengaged position shown in dash outline in FIG. 8A. Spacer shim 163 is held in the engaged position by means of a lock tab 65 which is dimensioned and configured to snap into place against the adjacent portion of mounting means 146 to hold spacer shim 163 in place. The spacer shim 163, when in its engaged position within shoulder recess 161, is dimensioned and configured to receive between it and mounting means 146 a narrow ladder side rail corresponding to side rail S, as shown in FIG. 6B. With spacer shim 163 moved to its disengaged position shown in dash outline, the shoulder space 161 is dimensioned and configured to receive a wider ladder side rail corresponding to side rail S' (FIG. 6B), such as the wider side rail typically used on commercial ladders as opposed to household type ladders. Although not essential, a second spacer shim (not shown) may be similarly positioned adjacent flange section 152*b*.

While the invention has been described in detail with reference to a particular embodiment thereof, it will be apparent that upon a reading and understanding of the foregoing, numerous alterations to the described embodiment will occur to those skilled in the art and it is intended to include such alterations within the scope of the appended claims.

What is claimed is:

1. A ladder accessory dimensioned and configured for mounting on a ladder having spaced side rails and a plurality of spaced parallel rungs connected thereto, which ladder accessory comprises:

(a) a support fixture comprising a tray assembly having (i) a tray having a tray floor and a continuous peripheral wall projecting transversely of the floor and terminating in a marginal rim of the peripheral wall, the peripheral wall extending about at least a portion of the periphery of the tray, and (ii) a cover affixed to the marginal rim of the peripheral wall and thereby spaced from the tray floor, the cover cooperating with the floor and the peripheral wall to define therewith a reservoir having an access opening defined between the tray floor and the cover, and (b) mounting means on which the support fixture is carried, the mounting means being dimensioned and configured to engage a ladder for mounting the ladder accessory on the ladder in a fixed position with the tray assembly positioned outside of the ladder and oriented substantially parallel to the ladder side rails with the access opening at the top of the reservoir.

2. The ladder accessory of claim 1 wherein the cover includes a first element of a disengageable seating means and the marginal rim of the peripheral walls includes a second element of the disengageable seating means, the seating means being dimensioned and configured to enable mounting and de-mounting of the cover on the tray assembly.

3. The ladder accessory of claim 1 wherein the disengageable seating means is dimensioned and configured to provide a liquid-tight seal between the cover and the tray.

4. The ladder accessory of claim 3 wherein the access opening is dimensioned and configured to admit therethrough the applicator of a painting implement.

5. A ladder accessory dimensioned and configured for mounting on a ladder having spaced side rails and a plurality of spaced parallel rungs connected thereto, which ladder accessory comprises:

(a) a support fixture comprising a tray assembly having (i) a tray having a tray floor and a continuous peripheral wall projecting transversely of the floor and terminating in a marginal rim of the peripheral wall, the peripheral wall extending about at least a portion of the periphery of the tray, and (ii) a cover affixed to the marginal rim of the peripheral wall and thereby spaced from the tray floor, the cover cooperating with the floor and the peripheral wall to define therewith a reservoir having an access opening defined between the tray floor and the cover, and (b) mounting means on which the support fixture is carried, the mounting means being dimensioned and configured to engage a ladder for mounting the ladder accessory on the ladder in a fixed position with the tray assembly oriented substantially parallel to the ladder side rails and the access opening at the top of the reservoir, said mounting means comprising a shoulder means extending transversely from one of said side walls and having a flange member depending therefrom, the flange member being spaced transversely from the side wall from which the shoulder means extends and extending substantially perpendicularly to the plane in which the cover lies when mounted on said tray, said flange member terminating in one or more recessed profiles defining a hook, said mounting means being dimensioned and configured to removably mount said tray assembly on a ladder with the longitudinal axis of the tray assembly substantially parallel to that of the side rails of the ladder.

6. A tray assembly dimensioned and configured for mounting on a ladder having spaced side rails and a plurality of spaced parallel rungs connected thereto, which tray assembly comprises:

(a) a generally rectangular tray having a tray floor, opposed side walls and opposed end walls projecting transversely of the tray floor and terminating in a marginal rim of the walls, the marginal rim projecting transversely from said walls, the tray floor being recessed at one end to provide a reservoir and having a substantially flat platform section extending on an incline towards the marginal rim as sensed in the direction moving from said reservoir to the opposite end of said tray;

(b) a generally rectangular cover dimensioned and configured to cover a portion of said tray over said reservoir, said cover along three marginal edges thereof being turned downwardly and then reversely turned inwardly in overlapping relation to itself to form a groove, said marginal rim and said groove being dimensioned and configured to enable mounting and demounting of the cover on said tray;

(c) seating means comprising a first element thereof disposed on the cover and a second element thereof disposed on the tray, said first and second elements cooperating to seat said cover on said tray; and (d) mounting means comprising a bracket member including a shoulder extending transversely from one of said side walls and having a downwardly bent flange means spaced from the side wall from which the shoulder extends and extending substantially perpendicularly to the plane in which the cover lies when mounted on said tray, said flange means terminating in at least one recessed profile defining a hook, said mounting means being dimensioned and configured to removably mount said tray assembly on a ladder with the longitudinal axis of the tray assembly substantially parallel to that of the side rails of the ladder.

7. The tray assembly of claim 6 wherein the cover has along its fourth marginal edge a flange turned away from said reservoir.

8. The tray assembly of claim 6 or claim 7 wherein said seating means are dimensioned and configured to provide a liquid-tight seal between the cover and the tray.

9. The tray assembly of claim 6 including a pair of said recessed profiles spaced apart from each other a distance such that each hook can engage a respective one of the rungs of the ladder and at least the profile of the uppermost of the hooks defines a distal claw, an arcuate center section, and a wing section extending beyond the arcuate section and defining a catch on the distal claw.

10. The tray assembly of claim 6 including two of said mounting means, one mounted on each of the opposite side walls of the tray.

11. A ladder accessory dimensioned and configured for mounting on a ladder having spaced side rails and a plurality of spaced parallel rungs connected thereto, which ladder accessory comprises:

(a) a support fixture comprising a tray assembly having (i) a tray having a tray floor and a continuous peripheral wall projecting transversely of the floor and terminating in a marginal rim of the peripheral wall, the peripheral wall extending about at least a portion of the periphery of the tray, and (ii) a cover affixed to the marginal rim of the peripheral wall and thereby spaced from the tray floor, the cover cooperating with the floor and the peripheral wall to define therewith a reservoir having an access opening defined between the tray floor and the cover, and (b) mounting means on which the support fixture is carried, the mounting means being dimensioned and configured to engage a ladder for mounting the ladder accessory on the ladder in a fixed position with the tray assembly oriented substantially parallel to the ladder side rails and the access opening at the top of the reservoir, the mounting means comprising a shoulder means extending transversely from one of the side walls and having a flange member depending therefrom and transversely spaced from the tray assembly, the shoulder means and the flange member cooperating to define therebetween a shoulder recess dimensioned and configured to receive a side rail of the ladder, the flange member terminating in at least one recessed profile defining at least one downwardly-facing hook at the upper end of the accessory, the hook being dimensioned and configured to engage a rung of the ladder, whereby the accessory can be removably mounted on the ladder with the shoulder recess engaging a side rail of the ladder and the hook engaging a rung of the ladder, with the tray assembly disposed laterally outwardly of the ladder.

12. The accessory of claim 11 further including longitudinally aligned spacer shims disposed within the shoulder recess to define therewithin a first and a second side rail recess, the first side rail recess being narrower and deeper than the second side rail recess.

* * * * *